US011517170B2

(12) United States Patent
Molina Cabrera et al.

(10) Patent No.: US 11,517,170 B2
(45) Date of Patent: Dec. 6, 2022

(54) SELF-CLEANING SQUEEGEE SYSTEM AND METHODS OF USING THE SAME

(71) Applicant: Avidbots Corp, Kitchener (CA)

(72) Inventors: Pablo Roberto Molina Cabrera, Waterloo (CA); Ian Gardiner, Kitchener (CA)

(73) Assignee: Avidbots Corp, Kitchener (CA)

( * ) Notice: Subject to any disclaimer, the term of this patent is extended or adjusted under 35 U.S.C. 154(b) by 647 days.

(21) Appl. No.: 16/519,942

(22) Filed: Jul. 23, 2019

(65) Prior Publication Data

US 2020/0029775 A1 Jan. 30, 2020

Related U.S. Application Data

(60) Provisional application No. 62/702,619, filed on Jul. 24, 2018.

(51) Int. Cl.

| | |
|---|---|
| ***A47L 11/40*** | (2006.01) |
| ***A47L 13/11*** | (2006.01) |
| ***A47L 13/502*** | (2006.01) |

(52) U.S. Cl.

CPC ..... *A47L 13/11* (2013.01); *A47L 11/4044* (2013.01); *A47L 13/502* (2013.01); *A47L 2201/00* (2013.01)

(58) Field of Classification Search

CPC ..... A47L 11/4044; A47L 13/502; A47L 13/11

See application file for complete search history.

(56) References Cited

U.S. PATENT DOCUMENTS

| | | | | |
|---|---|---|---|---|
| 4,198,724 A * | 4/1980 | Fisher | A47L 1/02 | 15/103 |
| 5,509,964 A * | 4/1996 | Boaz | B41M 1/12 | 118/406 |
| 6,524,386 B1 * | 2/2003 | Slager, Sr. | A47L 11/4088 | 118/305 |

* cited by examiner

*Primary Examiner* — Michael D Jennings

(57) ABSTRACT

A system for a self-cleaning squeegee that is integrated with a semi-autonomous cleaning device includes a frame coupled to the cleaning device. A squeegee is coupled to the frame and oriented such that an edge of the squeegee is in close proximity to a surface, e.g., a floor, for cleaning. A manifold configured to receive a cleaning fluid is coupled to the frame and oriented such that the cleaning fluid can be dispersed onto at least a portion of the squeegee. A connecting member is used to couple the manifold to an external fluid distribution system that provides the cleaning fluid. The self-cleaning squeegee system can thus disperse pressurized cleaning fluid, e.g., water or a mixture of water and soap, via the manifold to clean the surface of a squeegee. In this manner, the self-cleaning squeegee system can clean squeegees on the cleaning device without the need for human intervention.

15 Claims, 5 Drawing Sheets

SELF-CLEANING SQUEEGEE SYSTEM AND METHODS OF USING THE SAME

CROSS REFERENCE TO RELATED APPLICATIONS

The application claims priority to and the benefit of U.S. Provisional Patent Application Ser. No. 62/702,619, entitled "A SELF-CLEANING SQUEEGEE SYSTEM AND METHODS OF USING THE SAME", filed on Jul. 24, 2018, the disclosure of which is incorporated herein by reference in its entirety.

BACKGROUND

Embodiments described herein relate to a self-cleaning squeegee system for semi-autonomous devices. Semi-autonomous cleaning devices can be used to clean a building with minimal human interaction, which can reduce the time, cost, and labor for cleaning. However, over time, waste can accumulate on various cleaning components, e.g., a squeegee, on the semi-autonomous cleaning device. Human intervention is typically needed to perform cleaning and maintenance of the cleaning components, resulting in interruptions in the operation of the cleaning device and additional labor.

SUMMARY

Embodiments described herein relate to a system for a self-cleaning squeegee that is integrated with a semi-autonomous cleaning device (also referred to herein as a "cleaning device"). The self-cleaning squeegee system includes a frame coupled to the cleaning device. A squeegee is coupled to the frame and oriented such that an edge of the squeegee is in close proximity to a surface, e.g., a floor, for cleaning. A manifold configured to receive a cleaning fluid is coupled to the frame and oriented such that the cleaning fluid can be dispersed onto at least a portion of the squeegee. A connecting member is used to couple the manifold to an external fluid distribution system that provides the cleaning fluid. The self-cleaning squeegee system can disperse pressurized cleaning fluid, e.g., water or a mixture of water and soap, via the manifold to clean the surface of a squeegee. The self-cleaning squeegee system is configured to receive cleaning fluid from an internal source, e.g., an onboard container on the cleaning device, or from an external source, e.g., a docking station configured to perform maintenance on the cleaning device. In this manner, the self-cleaning squeegee system can clean squeegees on the cleaning device without the need for human intervention.

DETAILED DESCRIPTION

Semi-autonomous cleaning devices, e.g., a floor cleaning robot, can clean a building more thoroughly and reliably than a human operator while reducing the time, cost, and labor for cleaning. However, over time, the performance of the cleaning device can diminish or stop entirely as cleaning components, e.g., a squeegee, accumulates dirt, dust, debris and other waste. In order to maintain cleaning performance, the cleaning device is typically inspected, cleaned and maintained by a human at regular intervals. As a result, the cleaning device can only be operated autonomously for limited periods of time and additional labor is needed to perform cleaning and maintenance. Therefore, it is desirable for a semi-autonomous cleaning device to have a system capable of cleaning one or more cleaning components in an automated manner to reduce the need for human intervention and thus improve the autonomy of the cleaning device. This further increases the efficiency of the cleaning operation, allowing for a larger surface to be cleaned before required interventions by maintenance personnel.

The present disclosure is thus directed towards a system for a self-cleaning squeegee that is integrated with a semi-autonomous cleaning device. For example, the semi-autonomous cleaning device can be a floor cleaning robot as described in U.S. Patent Publication No. 2016/0309973 entitled, "Apparatus and Methods for Semi-Autonomous Cleaning of Surfaces", filed on Apr. 25, 2016 ("the '973 Publication"), the disclosure of which is incorporated herein by reference in its entirety and attached hereto as Exhibit A. In some embodiments, the self-cleaning squeegee system can disperse pressurized cleaning fluid (e.g., water or a mixture of water and soap, solvents, bleach), onto the surface of a squeegee to remove waste. The self-cleaning squeegee system can be configured to receive cleaning fluid from an internal source, e.g., an onboard container on the cleaning device, or from an external source, e.g., a docking station configured to perform maintenance on the cleaning device. In some embodiments, the self-cleaning squeegee system can be activated using a variety of mechanisms, including, but not limited to, remote activation by a human operator, automated activation by a preset schedule, detection of a dirt or a detection of degradation of cleaning performance, or by a physical trigger, e.g., the cleaning device presses a button on the docking station. Once activated, the self-cleaning squeegee system can clean the squeegee in an automated manner. In some embodiments, one or more self-cleaning squeegee systems can be contained on a single cleaning device to clean a plurality of squeegees on the front, sides, and rear of the cleaning device.

Figure 1:
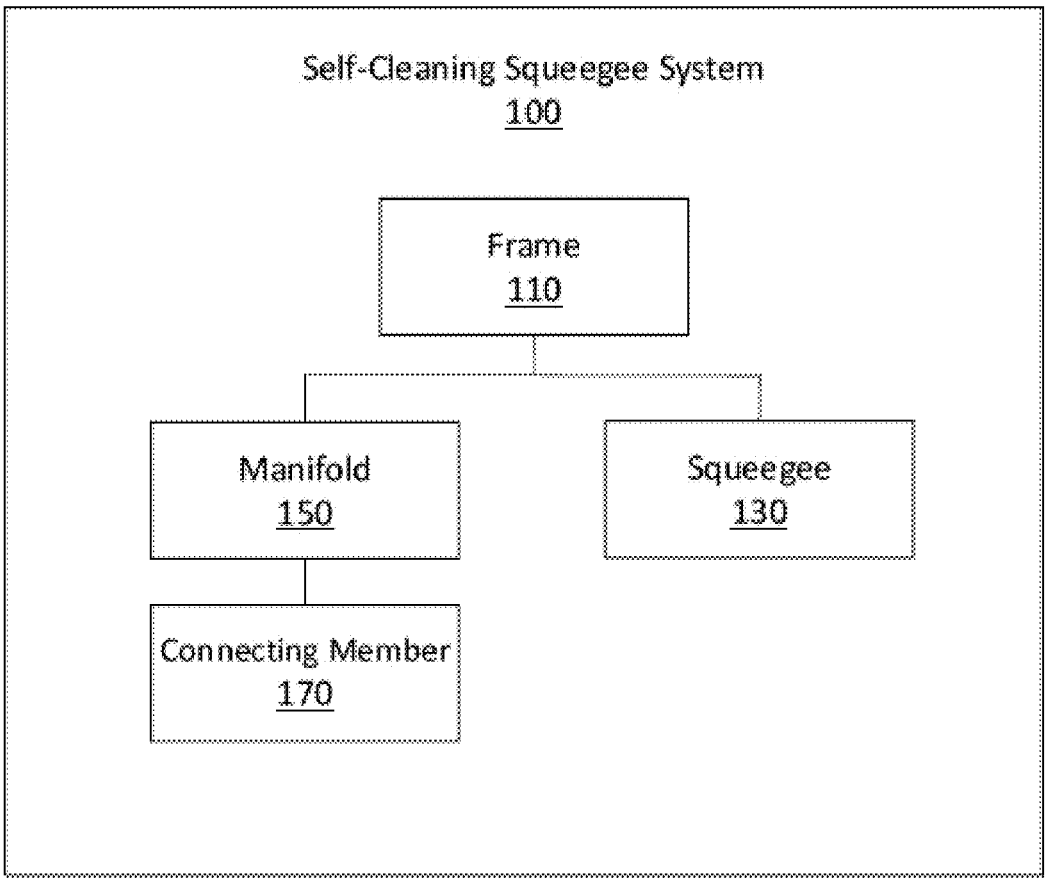
FIG. 1 is a schematic illustration of a self-cleaning squeegee system, according to an embodiment.

An exemplary embodiment of a self-cleaning squeegee system 100 is shown in FIG. 1. The self-cleaning squeegee system 100 includes a frame 110 coupled to a cleaning device. A squeegee 130 is coupled to the frame 110 and oriented such that an edge of the squeegee 130 is in close proximity to a surface, e.g., a floor, for cleaning. A manifold 150 is disposed and configured to receive a cleaning fluid and oriented such that the cleaning fluid can be dispersed onto at least a portion of the squeegee 130. In some embodiments, the manifold 150 can be coupled to the frame 110. In some embodiments, a connecting member 170 can be used to couple the manifold 150 to an external fluid distribution system (not shown) that provides the cleaning fluid.

As described herein, the frame 110 can be configured to mechanically support one or more components in the self-cleaning squeegee system 100. In some embodiments, the frame 110 can be shaped and dimensioned to substantially cover the width and/or the length of the cleaning device. In some embodiments, the frame 110 can be used to mechanically support the squeegee 130. For example, the frame 110 can be coupled the squeegee 130 such that an edge of the squeegee 130 is mechanically clamped by the frame 110. In some embodiments, the frame 110 can have a curvature configured to reduce the spread of a surface cleaning fluid dispersed by the cleaning device when cleaning the surface. For example, the self-cleaning squeegee system 100 can be disposed at the rear of the cleaning device where the frame 110 and the squeegee 130 have a convex curvature such that the surface cleaning fluid dispersed by the cleaning device can remain substantially confined to the path of the cleaning device by the squeegee 130.

In some embodiments, the frame 110 can also be used to mechanically support components on the cleaning device that are not integral to the self-cleaning squeegee system 100. For example, the frame 110 can support one or more wheel assemblies that function as bumpers to protect the cleaning device in the event of a collision with an obstacle or a barrier. In another example, the frame 110 can support one or more wheel assemblies with an actuation system configured to lower or raise the squeegee 130 such that the cleaning device can be toggled to clean while in operation.

The frame 110 can be formed from various metals, plastics, and composites including, but not limited to, aluminum, steel, polyethylene, polyvinyl chloride, polycarbonates, poly(methyl methacrylate), fiber glass, and carbon fiber. Depending on the material used to form the frame 110, various manufacturing methods can be used including, but not limited to, injection molding, casting, machining, milling, polishing, lapping, grinding, or any other method known to one of ordinary skill in the art.

The frame 110 can include a coupling feature (not shown) configured to couple the frame 110 to the cleaning device. In some embodiments, the coupling feature can be configured to allow the frame 110 to move relative to the cleaning device in order to reduce mechanical stress in the frame 110 that can arise from drag or frictional forces applied to the frame 110 from the surface via the squeegee 130. One or more coupling features can be coupled to the frame 110 and configured to allow the frame 110 to move relative to the cleaning device along one or more degrees of freedom. For example, the coupling feature can be a hinge disposed near the center of the frame 100 such that the frame 110 can rotate along an axis normal to the surface. In this manner, when the edges of the squeegee 130 contact the surface, the resulting drag force and torque applied to the frame 110 can cause the frame 110 to rotate about the coupling feature, thus reducing mechanical stress in the frame 110 and the coupling feature. In order to prevent the frame 110 from contacting other components on the cleaning device, e.g., the wheels or the frame of the cleaning device, the hinge can be configured to have a limited range of rotational motion of the frame 110.

The frame 110 can also be configured to support the manifold 150. In some embodiments, the frame 110 can define a hole (not shown) that allows a first portion of the manifold 150 to pass through the hole such the manifold 150 can receive cleaning fluid from a top side of the frame 110 and a second portion of the manifold 150 can disperse the cleaning fluid on a bottom side of the frame 110. In some embodiments, the frame 110 can include one or more slots or channels (not shown) configured to mate to at least a portion of the manifold 150 to orient the manifold 150 to disperse cleaning fluid towards the squeegee 130 and/or secure the manifold 150 to the frame 110.

In some embodiments, the frame 110 can also include one or more nozzle features (not shown) to modify the direction and spread of cleaning fluid from the manifold 150. For example, the frame 110 can include a pair of parallel protruding sidewalls that form a slot configured to receive a portion of the manifold 150. The protruding sidewalls can include one or more holes coupled to portions of the manifold 150 where cleaning fluid is dispersed such that the cleaning fluid is spread over a larger or smaller area of the squeegee 130. In another example, one or more nozzle components can be coupled to the frame 110 to modify the dispersion of cleaning fluid from the manifold 150.

The squeegee 130 can be used by the cleaning device to collect waste from the surface, particularly when the cleaning device disperses the surface cleaning fluid onto the surface. For example, the squeegee 130 can be a squeegee on a floor cleaning robot as described in the '973 Publication incorporated by referenced above. As described herein, as the squeegee 130 accumulates waste over time, cleaning performance can be degraded and the self-cleaning squeegee system 100 can be used to clean the squeegee 130 to maintain cleaning performance. In some embodiments, the squeegee 130 can be a substantially flat, thin member with at least one edge or side configured to be placed in contact with the surface to facilitate cleaning. The squeegee 130 can be shaped and dimensioned to cover at least a portion of the width, length, and/or ground clearance of the cleaning device. For example, the squeegee 130 can be a thin, rectangular component. The squeegee 130 can be oriented such that a bottom side of the squeegee 130, e.g., the side of the squeegee 130 that is oriented substantially parallel to the width of the cleaning device, is placed in contact with the surface.

In some embodiments, the squeegee 130 can be a compliant member where the edge or side of the squeegee 130 that contacts the surface can be compressed. In this manner, the squeegee 130 can substantially contact the surface for cleaning without causing damage to the surface or the squeegee 130. The squeegee 130 can also be bent when in contact with the surface in order to reduce the transfer of stress to other components in the self-cleaning squeegee system 100, e.g., the frame 110. In some embodiments, the compliancy of the squeegee 130 can be modified by coupling a mechanically rigid member to the compliant squeegee 130. For example, a plate, e.g., a thin metal sheet, can be coupled to the squeegee 130 to increase the mechanical stiffness in at least a portion of the squeegee 130.

The squeegee 130 can be coupled to the frame 110 such that the squeegee 130 substantially conforms to the shape of the frame 110. In some embodiments, a portion of an edge or side of the squeegee 130 can be mechanically clamped to the frame 110. For example, in embodiments where the squeegee 130 is a thin, generally rectangular component, a top side of the squeegee 130 can be coupled to the frame 110. In this manner, the squeegee 130 can form a mechanical flap where the top side is mechanically clamped to the frame 110 and the bottom side can move freely if the squeegee 130 is not in contact with the surface. The squeegee 130 can be coupled to the frame 110 using a variety of coupling mechanisms, including, but not limited to, adhesives, clamps, screw fasteners, and a press fit.

In some embodiments, one or more squeegees 130 can be disposed on the frame 110 to improve cleaning performance. For example, a first squeegee **130*a* and a second squeegee 130*b* (collectively referred to as squeegees 130) can be placed such that the bottom side of each squeegee 130 in contact with the surface is substantially parallel to one another. By adding another squeegee 130, the cleaning performance of the cleaning device can be improved, particularly in instances where a single squeegee 130 can fail to collect waste encountered by the cleaning device. In some embodiments, the one or more squeegees 130 can be positioned on the frame 110 such that the manifold 150 can clean one or more squeegees 130 simultaneously. For example, in embodiments where one or more squeegees 130 is used, as described above, the squeegees 130 can be spaced sufficiently apart such that the manifold 150 can be disposed between the squeegees 130. The manifold 150 can thus be configured to disperse cleaning fluid onto both squeegees 130 when the self-cleaning squeegee system 100** is activated.

The squeegee 130 can be formed from various rubber, plastics, and composites including, but not limited to, polyurethane, gum rubber, neoprene, polyethylene, polyvinyl chloride, polycarbonates, poly(methyl methacrylate). Depending on the material used to form the squeegee 130, various manufacturing methods can be used including, but not limited to, injection molding, machining, milling, polishing, lapping, grinding, or any other method known to one of ordinary skill in the art.

As described herein, the manifold 150 can be used to facilitate the transfer and dispersal of cleaning fluid to clean the squeegee 130. In some embodiments, the cleaning fluid can originate from the external fluid distribution system. The external fluid distribution system can include a container to store cleaning fluid, e.g., water or a water and soap mixture, a high pressure pump to pressurize the cleaning fluid, a valve to control the flow of cleaning fluid, and a piping system to direct the cleaning fluid from the external fluid distribution system to the manifold 150. In some embodiments, the external fluid distribution system can be disposed on the cleaning device such that the squeegee 130 can be cleaned regardless of the location of the cleaning device. In some embodiments, the external fluid distribution system can be disposed at a location separate from the cleaning device, e.g., on a docking system, configured to receive the cleaning device. In yet other embodiments, the cleaning fluid distribution system can include channels formed into one or more of the squeegees themselves to assist in the distribution of the cleaning fluid. These channels can be formed vertically and/or horizontally.

The manifold 150 can be coupled to the external fluid distribution system using the connecting member 170. The connecting member 170 can be various types of removable connectors, including, but not limited to, pipe fittings, clamps, and flanges. In this manner, the self-cleaning squeegee system 100 can be removable from the cleaning device to facilitate ease of assembly and maintenance. In some embodiments, the manifold 150 can be directly coupled to the external fluid distribution system using various connecting methods, including, but not limited to, soldering, brazing, and press fit connections.

The manifold 150 can be shaped and dimensioned to support the flow of pressurized cleaning fluids. For example, the manifold 150 can be a pipe with an open first end configured to couple to the external fluid distribution system and a closed second end to restrict the flow of cleaning fluid. The manifold 150 can be shaped such that a substantial portion of the manifold 150 is positioned and oriented proximate to the squeegee 130 to disperse cleaning fluid. For example, in some embodiments, the manifold 150 can be an L-shaped pipe where the longer segment of the manifold 150 is configured to disperse cleaning fluid onto a substantial portion of the squeegee 130 and the shorter segment is configured to receive cleaning fluid from the external fluid distribution system. In another example, the manifold 150 can be a T-shaped pipe with a central segment configured to receive cleaning fluid and the flanking segments configured to disperse cleaning fluid. The manifold 150 can have other shapes configured to disperse cleaning fluid onto the squeegee 130 according to a preferred areal coverage, e.g., one or more sides of the squeegee 130. In some embodiments, the manifold 150 can be configured to support pressurized cleaning fluids of about 300 psi.

The manifold 150 can be formed from various metals, plastics, and composites including, but not limited to, copper, chromed copper, chromed brass, cast iron, polyethylene, polyvinyl chloride, polycarbonates, poly(methyl methacrylate). In some embodiments, the manifold 150 can be formed from antimicrobial materials, e.g., copper, copper alloys, to reduce bacteria growth and spread in the self-cleaning squeegee system 100. Depending on the material used to form the manifold 150, various manufacturing methods can be used including, but not limited to, injection molding, casting, machining, milling, polishing, lapping, grinding, or any other method known to one of ordinary skill in the art.

As described above, the manifold 150 can be coupled to the frame 110 such that the first portion of the manifold 150, which includes the first end, passes through the hole in the frame 110 to couple to the external fluid distribution system while the second portion of the manifold 150 is disposed on the bottom side of the frame 110 to disperse the cleaning fluid. In some embodiments, the first portion of the manifold 150 can be coupled directly to the hole in the frame 110 or indirectly using the connecting member 170. In some embodiments, the coupling between the manifold 150 and the hole in the frame 110 can provide sufficient mechanical support to the manifold 150. In some embodiments, the second portion of the manifold 150 can also be coupled to the one or more slots or channels on the frame 110, as described above, on the frame 110 to provide additional mechanical support for the manifold 150. A variety of coupling mechanisms can be used, including, but not limited to, bonding, welding, a press fit, quick connect fittings, push to connect fittings, and any combination thereof, to mechanically secure the manifold 150 to the frame 110.

The manifold 150 can include a plurality of holes to disperse the cleaning fluid onto the squeegee 130. In some embodiments, the plurality of holes can be arranged and positioned along the second portion of the manifold 150 such that the manifold 150 disperses cleaning fluid substantially towards the squeegee 130. For example, in embodiments where the manifold 150 is an L-shaped pipe, the plurality of holes can be disposed along the longer segment of the manifold 150 such that cleaning fluid is dispersed substantially towards the squeegee 130. In some embodiments, each hole can function as a nozzle with sufficiently small dimensions so as to further increase the pressure of the cleaning fluid exiting the hole. In some embodiments, each hole can be dimensioned and arranged to couple to nozzle features, as described above, that modify the direction and spread of cleaning fluid dispersed onto the squeegee 130. In some embodiments, the manifold 150 can be configured to withstand sufficiently high pressures such that the pressure of cleaning fluid dispersed near the closed second end of the manifold 150, where the pressure drop can be large, remains sufficient to clean the squeegee 130. For example, the manifold 150 can be sufficiently large such that the pressure drop occurs primarily in the one or more nozzles in the manifold 150 and the pressure drop remaining substantially small across the main body of the manifold 150.

One or more manifolds 150 can also be disposed onto the frame 110 to clean the squeegee 130. In some embodiments, each manifold 150 in the one or more manifolds 150 can be configured to disperse cleaning fluid onto a separate portion along the same side of the squeegee 130. In some embodiments, the one or more manifolds 150 can be arranged to disperse cleaning fluids on one or more sides of the squeegee 130. For example, in embodiments where one or more squeegees 130 are disposed on the frame 110, a plurality of manifolds 150 can be arranged such that the front and rear sides of the squeegee 130 are cleaned by the plurality of manifolds 150. In some embodiments, the single connecting member 170 can be configured to couple the one or more manifolds 150 to the external fluid distribution system. In some embodiments, each manifold 150 can each have a corresponding connecting member 170 that couples to one or more ports on the external fluid distribution system.

The manifold 150 may be configured to disperse cleaning fluid at an angle most advantageous to cleaning the squeegee of debris. Depending on the nature of the debris and the configuration of the squeegee, the angle of dispersion may be selected to be substantially downward and substantially in the plane of the squeegee, to apply downward force on the debris; or the angle selected may be substantially toward the squeegee and substantially at a normal to the plane of the squeegee, to better break apart and dislodge debris on the squeegee; or the angle of dispersion may be somewhere in between these angles, to obtain a compromise between the benefits of both angles. A multi-angle dispersion system (not shown) may be used to allow for different angles of dispersion; such a system may involve two or more separate manifolds with different dispersion angles; a single manifold with multiple nozzles at different dispersion angles; a single manifold with variable dispersion angles, the angles controlled mechanically or manually; or some combination of these approaches.

Figure 2:
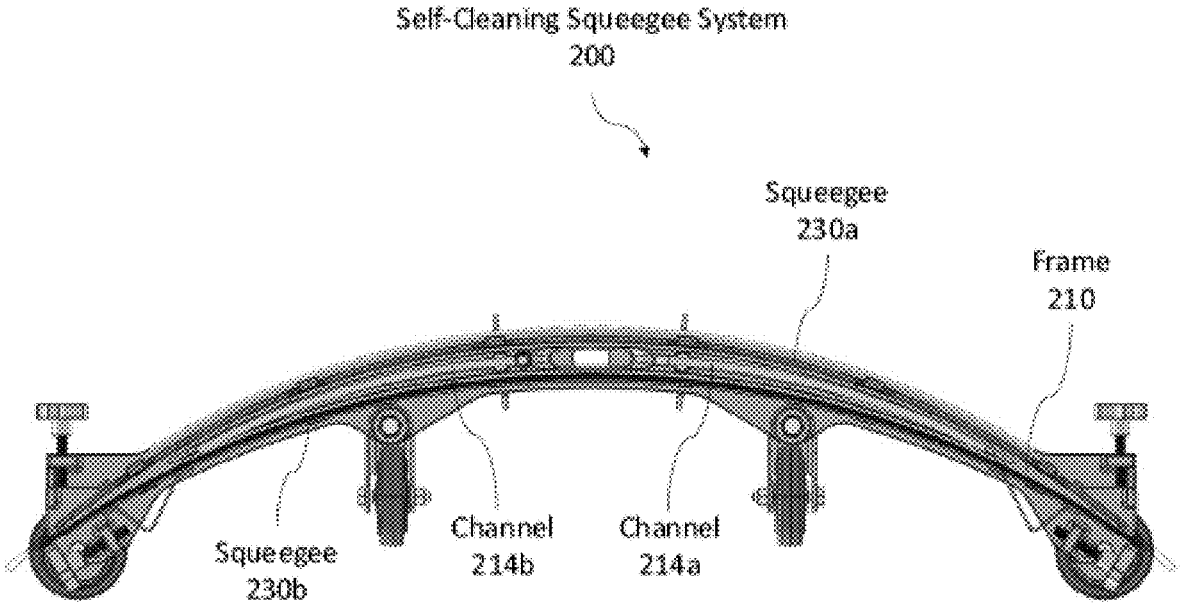
FIG. 2 is a bottom view of a self-cleaning squeegee system, according to an embodiment.
Figure 3:
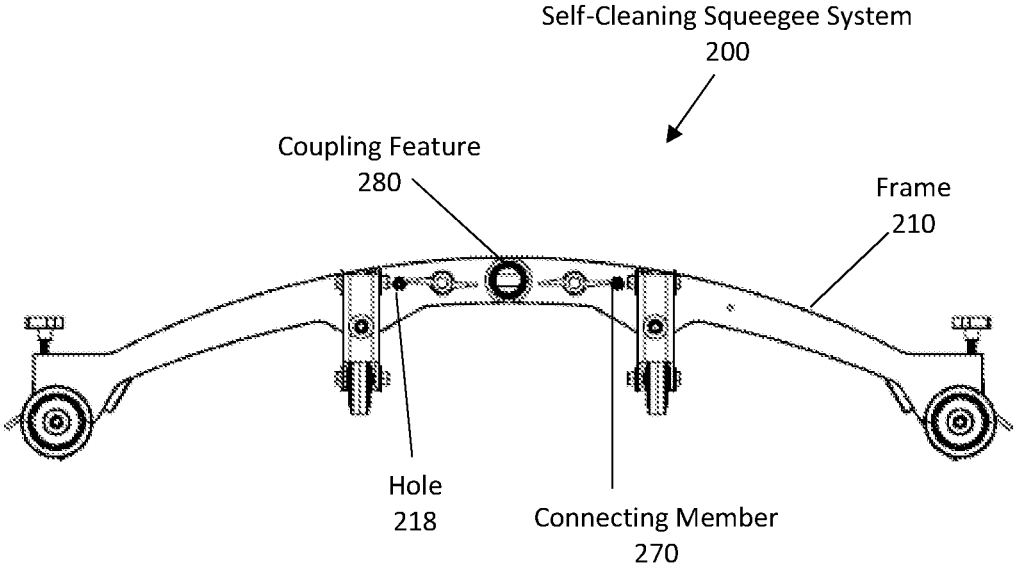
FIG. 3 is a top view of the self-cleaning squeegee system of FIG. 2.
Figure 4:
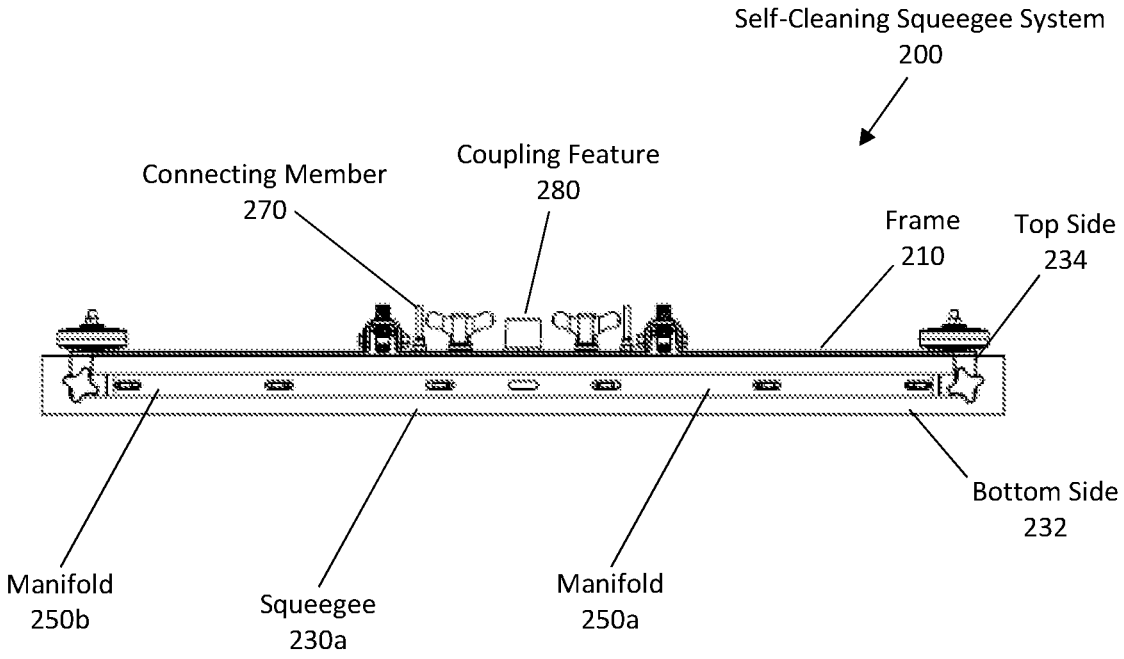
FIG. 4 is a front view of the self-cleaning squeegee system of FIG. 2.

An exemplary embodiment of a self-cleaning squeegee system 200 is shown in FIGS. 2-4. The self-cleaning squeegee system 200 can include a frame 210 with a curvature to control the collection and spread of surface cleaning fluid dispersed by a cleaning device during operation. As shown in FIG. 2, the frame 210 includes a first squeegee 230*a* disposed toward the front of the frame 210 and a second squeegee 230*b* (collectively referred to as squeegees 230) disposed toward the rear of the frame 210. As shown, the squeegees 230 substantially conforms to the curvature of the frame 210. The squeegees 230 can include a bottom portion 232 that contacts a surface and a top portion 234 that substantially couples to the frame 210. As shown in FIG. 3, the frame 210 can include a coupling feature 280 disposed near the center of the frame 210 to couple the frame 210 to the cleaning device.

The frame 210 can also include a first channel 214*a* and a second channel 214*b* (collectively referred to as channels 214) and holes 218 configured to couple a corresponding first manifold 250*a* and second manifold 250*b* (collectively referred to as manifolds 250) to the frame 210. As shown in FIG. 4, the manifolds 250 can be L-shaped pipes with the shorter segment disposed vertically to receive cleaning fluid and the longer segment disposed horizontally along the frame 210 to clean a portion of the squeegee 230. The longer segments of the manifolds 250 can include one or more holes (not shown) to disperse cleaning fluid onto the manifolds 250. A corresponding set of connecting members 270 can be used to couple the pair of manifolds 250 to an external fluid distribution system that provides cleaning fluid to the self-cleaning squeegee system 200. When the external fluid distribution system is activated, cleaning fluid can flow into the self-cleaning squeegee system 200 and dispersed by the manifold 250 to clean the squeegee 230. In this manner, the squeegee 230 can be cleaned in an automated manner.

Referring back to FIG. 2, self-cleaning squeegee system 200 consists of a first squeegee 230*a* disposed toward the front of the frame 210 and a second squeegee 230*b* disposed toward the rear of the frame 210. Both squeegee 230*a* and 230*b* consist of a single layer squeegee blade design. In further embodiments, the squeegee can be designed to include multi-layer squeegee blades where additional blades can be added to frame 210.

In further embodiments, various additional features may be added to the squeegee system to enhance cleaning and dirt removal. In a further embodiment, mini-tubes can be added along the second rear squeegee to vacuum debris.

In a further embodiment, bristle brushes with vacuuming capabilities may be added along the leading edge of the second rear squeegee. Further, bristle brushes may also be placed in the channel between first (front) and second (rear) squeegee.

Figure 5:
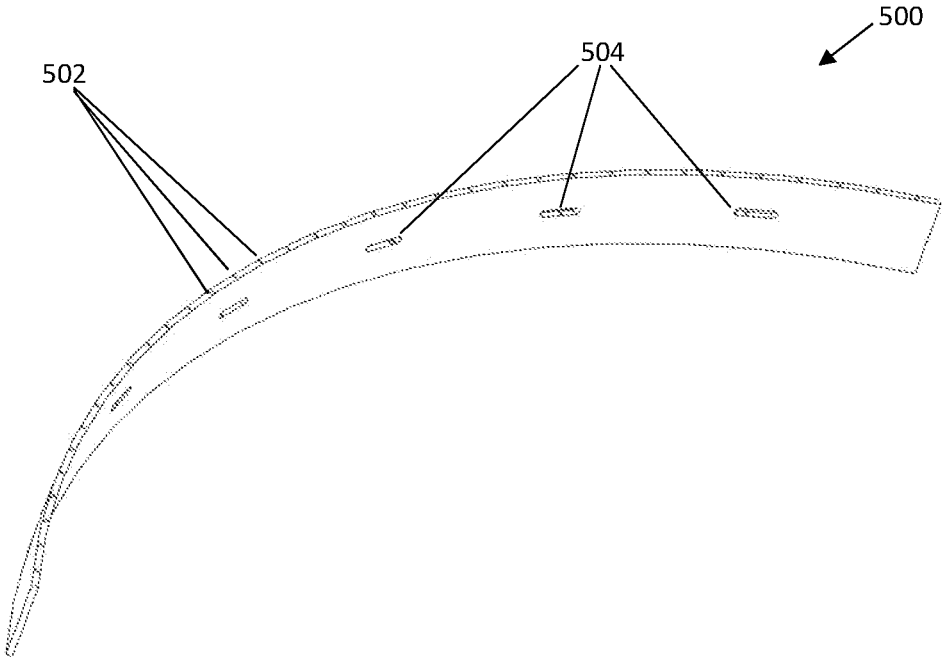
FIG. 5 is a perspective view of a self-cleaning squeegee blade.

In other embodiments, one or more squeegees can be produced with channels facing downward and longitudinally along the lower edge of the squeegee. This provides for an improved wiping mechanism, and can be used in conjunction with the self-cleaning function to provide an improved cleaning function. Airflow from the environment into the suction chamber between the squeegee blades can be directed through channels in such a way as to augment the self-cleaning function. FIG. 5 is a perspective view of a self-cleaning squeegee blade. Squeegee blade 500 has several mounting holes 504 to mount squeegee blade 500 to the frame 210 Squeegee blade 500 also has a plurality of internal delivery channels 502 for the delivery of either air (i.e., to blow compressed air or vacuum) or a fluid such as water, detergent, cleaner, soap etc. The internal delivery channels 502 may be evenly spaced apart every 0.5 inch to 1 inch. In other embodiment internal delivery channels may be more concentrated closer to the outer edges of the squeegee blade 500.

In other embodiments, the cleaning fluid can be selected to be an effective solvent for the types of dirt and debris that are being cleaned from the surface. For example, different mixtures of cleaning fluids may be chosen for surfaces known to be dusty or oily. In further embodiments, the self-cleaning system may also provide a mechanism to adjust the type of solvent based responsive to the types of materials on the floor to be cleaned.

In further embodiments, the self-cleaning squeegee system may have a vibration motor or mechanism such as a piezo-electric actuator mounted along the squeegee blade to shake the squeegee system. By controlling the motor frequency, one can dislodge (or shake off) the debris from the squeegee blade(s). The vibration mechanism may be actuated at different frequencies, including ultrasonic frequencies.

In yet a further embodiment, the self-cleaning squeegee system may incorporate vacuum suction type design using a vacuum, motors and double helix rotating drum. The front edge of the squeegee blade acts as a shovel. Debris that is trapped on the front edge of the squeegee blade (shovel) is directed by a helix drum towards the center of the squeegee. At the center, the debris is extracted by a vacuum system.

While various inventive implementations have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive implementations described herein. More generally, those skilled in the art will readily appreciate that all parameters and configurations described herein are meant to be exemplary inventive features and that other equivalents to the specific inventive implementations described herein may be realized. It is, therefore, to be understood that the foregoing implementations are presented by way of example and that, within the scope of the appended claims and equivalents thereto, inventive implementations may be practiced otherwise than as specifically described and claimed. Inventive implementations of the present disclosure are directed to each individual feature, system, article, and/or method described herein. In addition, any combination of two or more such features, systems, articles, and/or methods, if such features, systems, articles, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, implementations may be constructed in which acts are performed in an order different than illustrated, which may include performing some acts simultaneously, even though shown as sequential acts in illustrative implementations.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one implementation, to A only (optionally including elements other than B); in another implementation, to B only (optionally including elements other than A); in yet another implementation, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one implementation, to at least one, optionally including more than one, A, with no B present (and optionally including elements other than B); in another implementation, to at least one, optionally including more than one, B, with no A present (and optionally including elements other than A); in yet another implementation, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A cleaning system with a self-cleaning squeegee system and a semi-autonomous cleaning device, comprising:

a frame configured to substantially cover a bottom side of the semi-autonomous cleaning device, the frame having a top side and a bottom side, wherein a first portion of the top side of the frame is coupled to the bottom of the semi-autonomous cleaning device;

a squeegee configured to clean a surface, the squeegee having a top side coupled to the bottom side of the frame and a bottom side configured to be in contact with a floor; and a manifold configured to receive and disperse a cleaning fluid, the manifold having a first end to receive the cleaning fluid and a second end to restrict flow of cleaning fluid;

wherein the frame and the squeegee have a convex curvature such that the cleaning fluid is dispersed by the semi-autonomous cleaning device remain substantially-confined to the path of the semi-autonomous cleaning device by the squeegee.

2. The cleaning system of claim 1, wherein the manifold is a substantially L-shaped pipe with a first segment configured to receive the cleaning fluid and a second segment configured to disperse the cleaning fluid.

3. The cleaning system of claim 2, wherein the frame includes a hole that allows the first segment of the manifold to pass through the hole such that the first end of the manifold is disposed on the top side of the frame.

4. The cleaning system of claim 2, wherein the second segment of the manifold includes a plurality of holes configured to disperse cleaning fluid onto at least a portion of the squeegee.

5. The cleaning system of claim 1, wherein a connecting member is used to couple the first end of the manifold to an external distribution system configured to supply the cleaning fluid.

6. The cleaning system of claim 1, wherein the squeegee is placed in the front portion of a semi-autonomous cleaning device.

7. The cleaning system of claim 1, wherein the squeegee further comprises a front squeegee blade and a rear squeegee blade.

8. The cleaning system of claim 7 further comprising at least one channel between the front squeegee blade and the rear squeegee blade.

9. The cleaning system of claim 1, wherein the cleaning fluid is selected from a list consisting of water, soap, mixture of water and soap, solvents and bleach.

10. The cleaning system of claim 1 further comprising a cleaning fluid distribution system.

11. The cleaning system of claim 10, wherein the cleaning fluid distribution system is external.

12. The cleaning system of claim 1, wherein the squeegee further comprises a plurality of mounting holes for coupling to the frame.

13. The cleaning system of claim 1, wherein the squeegee further comprises a plurality of internal delivery channels for delivery of air or fluid.

14. The cleaning system of claim 1 further comprising a vacuum system to suction air or fluid.

15. The cleaning system of claim 1 further comprising a vibration motor to shake debris from the squeegee.

* * * * *